US005501627A

United States Patent [19]

Ekstein

[11] Patent Number: 5,501,627

[45] Date of Patent: Mar. 26, 1996

[54] CHILDREN'S TOY WITH PEEK-A-BOO ACTIVATION

[76] Inventor: Penny Ekstein, 155 E. 55th St., New York, N.Y. 10022

[21] Appl. No.: 345,562

[22] Filed: Nov. 8, 1994

[51] Int. Cl.[6] ..... A63H 3/28

[52] U.S. Cl. ..... 446/175; 446/297; 446/901

[58] Field of Search ..... 446/175, 130, 446/139, 297, 303, DIG. 901

[56] References Cited

U.S. PATENT DOCUMENTS

| | | | |
|---|---|---|---|
| 3,274,729 | 9/1966 | Refabert | 446/175 X |
| 3,672,096 | 6/1972 | Johmann | 446/338 |
| 3,789,547 | 2/1974 | Chemarin | 446/DIG. 901 X |
| 3,867,786 | 2/1975 | Greenblatt | 446/130 |
| 4,687,457 | 8/1987 | Milner | 446/175 |
| 5,071,385 | 12/1991 | Cox | 446/139 X |
| 5,376,038 | 12/1994 | Arad et al. | 446/297 |

*Primary Examiner*—Mickey Yu

[57] ABSTRACT

A child's toy has an electrically actuated function such as talking or moving which function is initiated by first covering a sensor and then, within a short time, uncovering the sensor. In a preferred arrangement, a stuffed doll includes potodetectors located in the area of the doll's eyes and movable arms configured such that the hands of the doll may be placed over the doll's eyes and then promptly removed from the doll's eyes whereupon the doll's speech synthesizer produces a message such as "peek-a-boo."

11 Claims, 4 Drawing Sheets

CHILDREN' S TOY WITH PEEK-A-BOO ACTIVATION

BACKGROUND AND SUMMARY OF THE INVENTION

The present invention relates generally to the field of children's toys of the type having an electrically activated "behavior" such as crying or making some other sound, or perhaps, waving a hand, dancing, kicking, or rolling over. The nature of the activity of the toy is not of primary concern here, but rather the manner in which the activity is activated. For convenience in describing the invention, most of the description that follows is directed to a talking doll, but the invention is not limited to this particular form of implementation. In the use of toys that have some electrically operated feature, such as simulating a voice, either crying, singing or speaking some message, there is a need for some activation of the electrical apparatus within the toy. For instance, it is well known that a pull string may be employed to activate a crying doll or a doll that says, "Mama". Additionally, it is known to include a button which may be depressed to activate a speaking doll. In other children's toys it is known to turn a crank, pick up the toy, push a button, toggle a toggle switch and make a sufficiently loud noise. Each of these activation techniques have been used in children's toys for the purpose of activating noise making features of the toy.

In the field of electric lighting, it is known to use a photosensor to detect darkness, and, in response to detection of darkness, to activate an electric light. A typical product relying on this feature is an electric streetlight. Additionally, security lighting is available which is activated upon detection of darkness through the use of photosensors. Still another product which relies on photosensors for activation is a commonly available night light. Each of these products monitor the amount of light received by the photosensor, and when the amount of light received drops below a pre-established threshold, the light is turned on.

Certain children's toys have also included light sensors for activation of an audible signal in response to detected light. For instance, U.S. Pat. No. 4,675,519 describes a doll having an optical sensor in the face portion of the doll for creating a voltage in response to light received and then providing an audible signal in response to the changes in the amount of light received. Additionally, the doll described in this patent includes light emitting devices in the eyes of the doll which emit light when the audible signals are generated.

Another doll is disclosed in U.S. Pat. No. 5,158,492 which, upon detection of a sufficient amount of light, is activated to move in a predetermined fashion. Also, U.S. Pat. No. 5,281,180 discloses another light activated doll, this one responding to light by speaking through the use of a speech synthesizer. Another doll with synthesized speech is disclosed in U.S. Pat. No. 4,840,602, where a radio signal is employed to activate the speech synthesis portion of the doll.

The present invention introduces an additional control feature into the previously known arrangements for actuating a speaking doll through the use, for instance, of a photosensor. By providing a photosensor in either or both eyes of a doll, and additionally providing a speech synthesizer within the doll, actuation of the speech function is regulated by first, exposure to light, and then secondly, by arranging the hands of the doll over the dolls eyes to thereby deactivate the photosensors' operation, even when the doll is exposed to sufficient light to otherwise activate the speech synthesizer. In another arrangement of the invention, the activation of the speech synthesizer is through depression of a pressure switch located at the eye locations of the doll. Again, through covering of the eyes of the doll with the doll's hands, the speech synthesizer is controlled. It is noted, that speech may be either suppressed or activated upon covering of the eyes of the doll. Still another manner of controlling the speech synthesizer is through the use of electrical contacts at one or both eyes of the doll such that covering of the eyes with the hands of the doll completes a circuit. This arrangement may be best implemented through the provision of a thin wire through the hand of the doll, along the arm and then to the speech synthesizer switch. The hand may include a small electrically conductive pad and the eye may include an electrically conductive contact.

It is contemplated that a fastening device, such as a hook and loop fastener or a snap or button would be employed to hold the doll's hands over the doll's eyes. This would allow the child playing with the doll to have continuous activation of the speech synthesizer or continuous deactivation of the speech synthesizer, depending on whether the dolls eyes were covered by the doll's hands. Upon activation of the speech synthesizer by uncovering the eyes, for instance, speech would be generated whenever sufficient light strikes the photosensor.

OBJECTS OF THE INVENTION

It is an object of the present invention to provide activation of a speaking doll upon initially covering and then uncovering the eyes of the doll.

It is another object of the present invention to provide a doll that, through the use of a speech synthesizer, says "peek-a-boo" whenever the eyes of the doll are first covered by the hands of the doll and are then uncovered by removal of the hands of the doll from the eyes of the doll.

It is still another object of the invention to provide a doll having a speech synthesizer activated by operation of a switch located in the area of the eyes of the doll.

It is also an object of the present invention to provide a fastener in the area of the eyes of a doll which is suitable for securing the hands of the doll over the eyes of the doll.

It is another object of the invention to provide a children's toy including a photosensor for activation of an electrically operated function of the toy and further including a movable member affixed to the toy capable of covering the light receiving portion of the photosensor to block receipt of light by the photosensor and thereby inhibit activation of the electrically operated function of the toy.

DETAILED DESCRIPTION OF THE INVENTION

Figure 1:
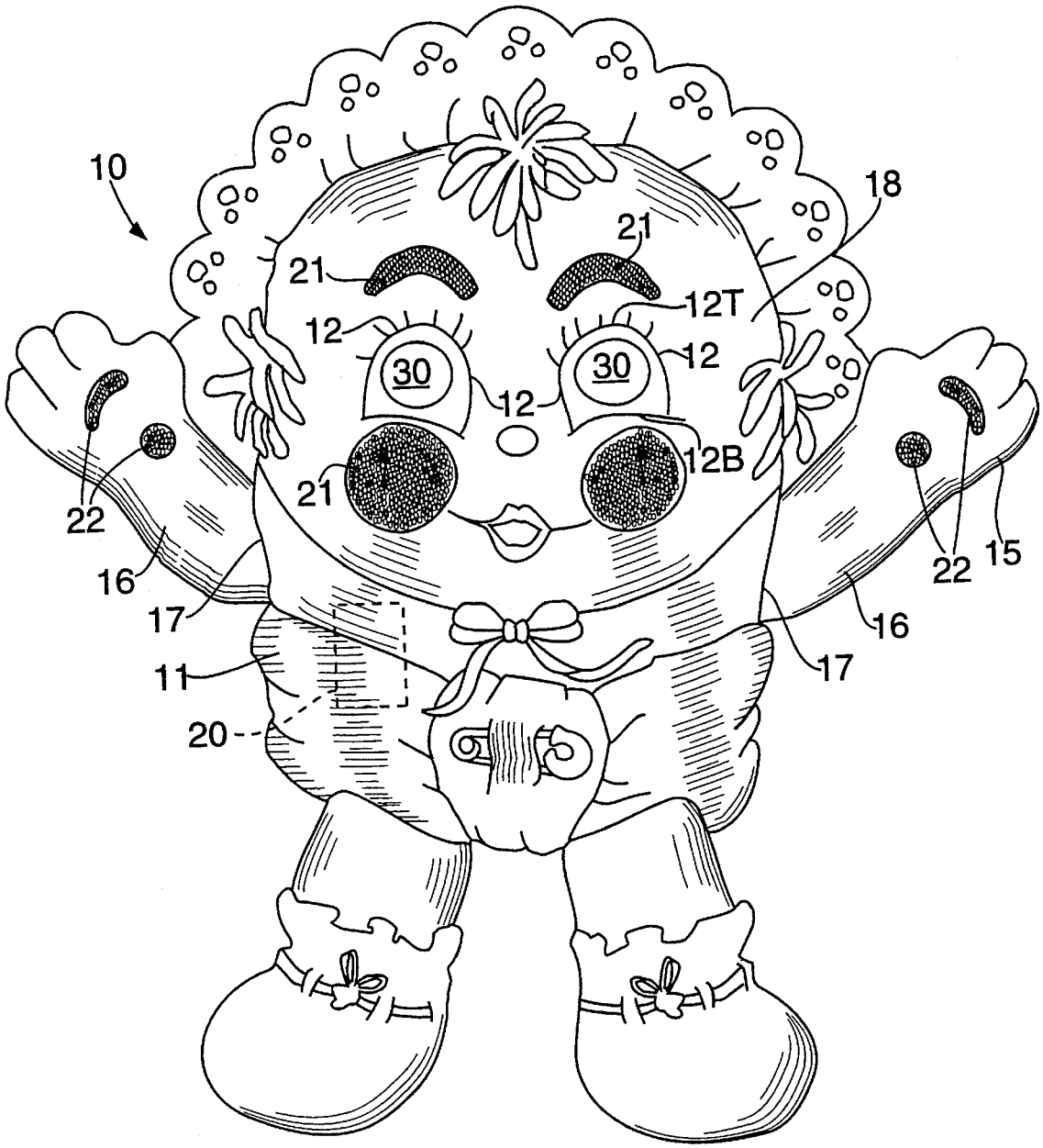
FIG. 1 illustrates a first embodiment of the invention.

Referring to FIG. 1, a doll 10 is illustrated having a speech synthesizer 20 located within the body 11 of doll 10. Each eye 12 of the doll is fitted with a switch in the form of a photodetector 30 which is electrically connected to the speech synthesizer. Above and below each eye are fasteners 21 suitable for fastening to fasteners 22 located on each hand 15. Arms 16 are flexible so the hands may be readily moved from the normal rest position, as illustrated, to a position covering the eyes 12 of the doll. In a preferred embodiment, a folding seam 17 is provided on each arm at a location such that the hands are positioned over the eyes when the arms are folded along folding seam 17.

Speech synthesizer 20 is preferably of a type that can synthesize multiple messages, one of which is produced each time the speech synthesizer is activated. In this arrangement, when the eyes of the doll are covered, the speech trigger circuit 52 is reset and upon uncovering of the eyes, the speech trigger circuit is actuated and the speech synthesizer is activated for production of a single message, such as, "peek-a-boo." While there are numerous options available for such synthesizers, it would be suitable to use a speech synthesizer of the general type described in one of U.S. Pat. Nos. 4,840,602 or 4,675,519.

The output of the speech synthesizer is directed to a speaker 55 (either directly, or via an amplifier 54) for creation of audible speech. The operation of this output function is not described in detail here. Examples of suitable speakers are found in each of U.S. Pat. Nos. 4,675,519, 4,840,602 and 5,281,180. Similarly, the manner in which the output of the speech synthesizer is provided to the speaker is described in the above patents. The specific manner in which this is accomplished is not of significant concern for purposes of the present invention.

Figure 2:
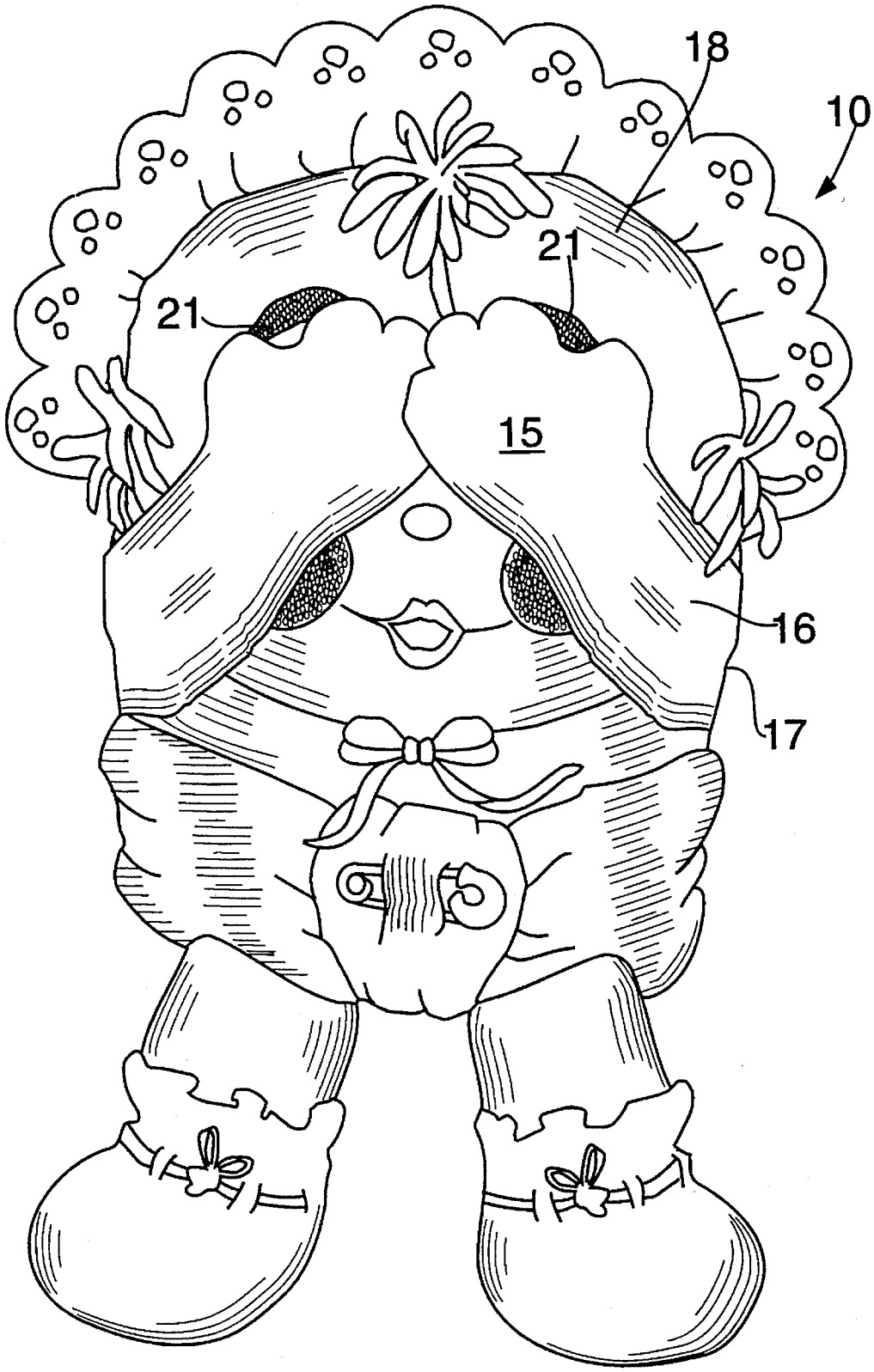
FIG. 2 illustrates a the embodiment of FIG. 1 with the eyes covered by the hands of the doll.

FIG. 2 shows another view of the hands 15 and face 18 of the doll of FIG. 1. Each hand is sized relative to the face such that the hand 15 is sufficiently large to cover an eye 12 of the doll. The two strips of hook and loop fastening material 22 which are provided on the hand, spaced apart by an amount exceeding the distance from the top 12T to the bottom 12B of the doll's eye, as shown in FIG. 1. Similarly, corresponding strips of hook an loop fastener 21 are provided on the face of the doll, above and below each eye of the doll. It would be equally feasible to provide the hook and loop fastener 21 on the sides of the eyes rather than above and below, it being intended only that the fastener secure the hand in a position covering the eye. The covering of the eye is important because the photodetector is located at the location of the eye. In the event that the photodetector is located at some other portion of the face, then the location of the fasteners would have to be accordingly relocated. It is to be understood that the use of hook and loop fastening strips is only one of many potential fastening mechanisms which will serve the purpose of the invention. For instance, buttons or snaps would be well suited for securing the hand to the face, at a location covering the eye.

Figure 3:
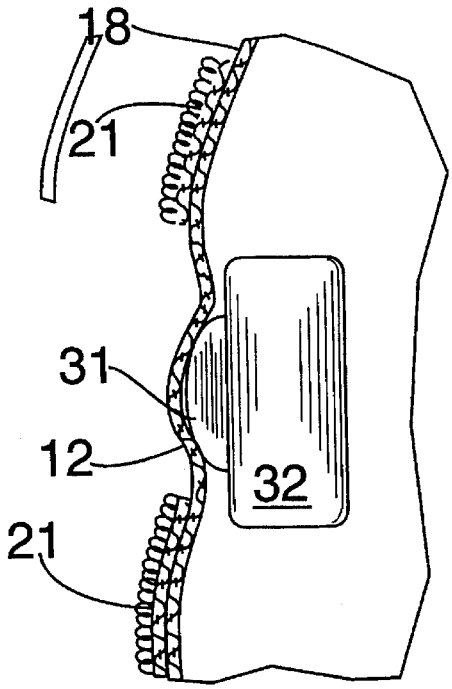
FIG. 3 illustrates, in cross section, a stiffened embodiment of a doll's hand adapted for physically depressing a push-button type switch.
Figure 4:
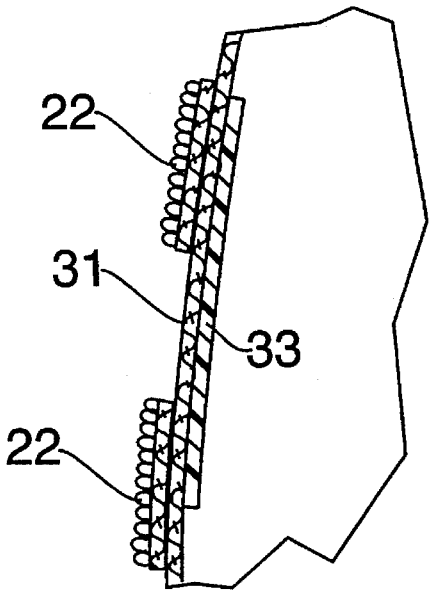
FIG. 4 illustrates, in cross section, a doll's eye having a push button type switch suitable for activating an electrical function of a doll.

FIG. 3 illustrates a variation in activation technique, relying on the depression of a button 31 which, when depressed, activates switch 32. In this arrangement, the covering of the eyes with sufficient force to depress button 31 will reset the speech trigger circuit 52. Then, upon release of the button, the speech synthesizer is activated to produce speech. To aid in obtaining adequate depression force on the button when the hands of the doll are placed over the eyes, a stiff member 33 is included in hand 15 as illustrated in FIG. 4. As with the previous embodiment, fasteners are provided above and below the doll's eyes and corresponding fastening strips are provided on the hands. The extra stiffness provided by the stiffening member will assure that the button is depressed when the hand is fastened over the eye.

Figure 5:
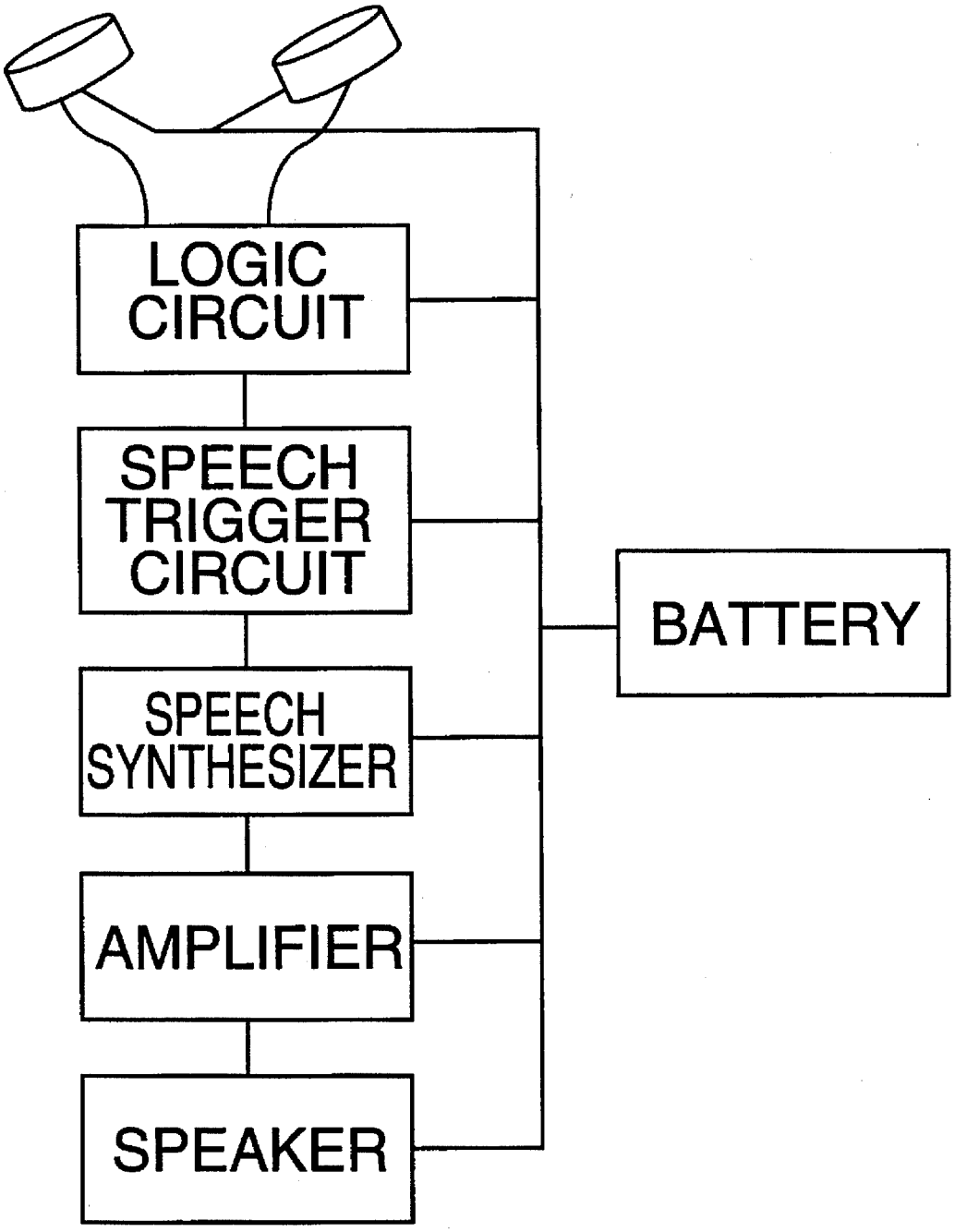
FIG. 5 is a schematic diagram of the sound generating circuit.

FIG. 5 provides a general indication of the manner in which the activation of the audible speech is accomplished. When either of the photodetectors 30 are not sensing light, the logic gate 51 (in this situation, an OR gate) provides a TRUE indication to the speech trigger circuit 52. This resets the trigger circuit. Then, when both photodetectors detect light, a FALSE signal is provided to the speech trigger circuit 52 and an output signal from the speech trigger circuit is provided to the speech synthesizer 20 to activate the production of a spoken message. The output of the speech synthesizer is provided to amplifier 54 and the amplified signal is provided to the speaker 55.

In an alternative arrangement, the logic gate provides a reset signal only when neither of the photosensors 30 are sensing light. This requires that both eyes be covered before the trigger circuit 52 is reset. Additionally, the logic gate in this embodiment only calls for activating the speech trigger circuit when both eyes are sensing light. This means that speech is only generated when there has first been a blocking of light from both eyes and then light is admitted into both eyes. In the earlier arrangement, speech would be activated when first at least one eye is blocked and then both eyes are thereafter exposed to light.

An additional feature of the invention which avoids automatic activation each morning, even when there has been no covering of the eyes, is the provision of a timer in the speech trigger circuit. The timer feature would prevent sending of a speech activation signal unless there has been an initial light period prior to the covering of the eyes. In a preferred arrangement, the period during which the eyes are not receiving light should be less than about 15 minutes. This will extend the useful life of the battery 56 employed for powering the unit.

In addition to the specific examples provided herein, it is also possible to sense the covering of the eyes of the doll by providing an electrical contact at the location of the eye and a corresponding electrical contact on the palm of the hand of the doll. Then, when the hand is placed over the eye, the two electrical cotacts will complete a circuit, providing a signal to the speech trigger circuit. Then, as with the signal provided by the other switch alternatives, the speech synthesizer may be activated when the hands are removed from the eyes. In similar fashion to the previously described embodiments, a timer could be advantageously employed to prevent activation until the switch is activated and then deactivated within a predetermined time period. For purposes of activating the speech trigger circuit, it would be equally feasible for the switch to be deactivated and then activated, it being understood that the logical sequence is that the hands are placed over the eyes and then removed within a reasonably short period of time, approximating the time period suitable for playing peek-a-boo. As stated above, this should be less than 15 minutes, and in a preferred arrangement would be less than about 30 seconds.

In addition to the use of a doll for the peek-a-boo features of the invention, it would be equally feasible to use any other stuffed animal. As with the doll, the "hand" of the stuffed animal should be arranged so it can easily be placed over the eye of the animal. This can be rendered quite easy if a seam is provided on the upper arm portion of the stuffed animal approximately half the distance from the animal's eye to the animal's hand. As will be readily appreciated, it is not necessary that the doll or animal be stuffed, but rather that there be sufficient mobility of the arm and hand to allow the hand to be placed over the eye of the animal or doll.

While the present invention has been described in connection with several specific embodiments, and in connection with several alternatives, it is to be understood that the invention is not limited to these specific embodiments and variations thereof, but is broadly applicable to all implementations of the overall concept described herein. The claims appended hereto are to be read in the broadest manner possible consistent with the principles set forth herein and in light of the prior art as it necessarily limits the scope of patentability.

I claim:

1. A doll having a body, a first eye located on a head portion of said body, a first hand and a first flexible arm connecting said first hand to said body, said body containing a speech synthesizer for producing a speech signal, a speech trigger circuit for activating said speech synthesizer and a speaker for producing an audible output in response to a speech signal produced by said speech synthesizer, said first eye containing a first switch responsive to covering and uncovering said first eye, said first switch providing an indication to said speech trigger circuit that said first eye is either covered or uncovered, and a fastening means for releasably fastening said first hand over said first eye said doll further comprising a second eye, a second hand and a second flexible arm, and wherein said second eye contains a second switch responsive to covering and uncovering said second eye, said second switch providing an indication to said speech trigger circuit that said second eye is either covered or uncovered, and said speech trigger circuit providing a speech activation signal to said speech synthesizer in response to receipt of an indication that both of said first and second eyes have initially become covered, and then within a predetermined time period thereafter, that said first and second eyes have both become uncovered.

2. A doll as claimed in claim 1 wherein said predetermined time period is about 15 minutes or less.

3. A doll as claimed in claim 1 wherein said predetermined time period is about 30 seconds or less.

4. A doll as claimed in claim 1 wherein said predetermined time period is commenced when said first and second eyes substantially simultaneously transition from an uncovered to a covered condition.

5. A doll as claimed in claim 1 wherein said first and second switches comprise photodetectors.

6. A doll as claimed in claim 1 wherein said first and second switches comprise push button switches.

7. A doll as claimed in claim 1 wherein said speech signal is synthesized speech including the phrase "peek-a-boo".

8. A doll as claimed in claim 1 wherein said first and second eyes are located adjacent a first and second fastening means respectively provided on the head portion of said body.

9. A doll having first and second eyes, first and second switches associated respectively with said first and second eyes, and a speech generating system, said speech generating system being activated to generate speech only when said first and second switches are initially switched from a first condition to a second condition, and then within a predetermined time period said first and second switches are switched from said second condition to said first condition.

10. A doll as claimed in claim 9 wherein said predetermined time period is about 30 seconds or less.

11. A doll as claimed in claim 9 wherein said predetermined time period is about 15 minutes or less.

* * * * *